US012599830B2

(12) United States Patent
Judge

(10) Patent No.: US 12,599,830 B2
(45) Date of Patent: Apr. 14, 2026

(54) TRAINING DEVICE FOR BALL SPORTS

(71) Applicant: NET WORLD SPORTS LTD, Wrexham (GB)

(72) Inventor: Daniel Judge, Cambridge (GB)

(73) Assignee: GLOBALTEC INNOVATIONS LTD, Colchester Essex (GB)

( * ) Notice: Subject to any disclaimer, the term of this patent is extended or adjusted under 35 U.S.C. 154(b) by 77 days.

(21) Appl. No.: 18/559,371

(22) PCT Filed: May 6, 2022

(86) PCT No.: PCT/IB2022/054225
§ 371 (c)(1),
(2) Date: Nov. 7, 2023

(87) PCT Pub. No.: WO2022/234534
PCT Pub. Date: Nov. 10, 2022

(65) Prior Publication Data

US 2024/0226697 A1 Jul. 11, 2024

(30) Foreign Application Priority Data

May 7, 2021 (GB) ..... 2106573

(51) Int. Cl.
*A63B 69/40* (2006.01)
*A63B 69/00* (2006.01)

(52) U.S. Cl.
CPC ..... *A63B 69/406* (2013.01); *A63B 69/002* (2013.01); *A63B 69/40* (2013.01); *A63B 2069/402* (2013.01); *A63B 2243/0025* (2013.01)

(58) Field of Classification Search
CPC .. A63B 69/40; A63B 69/406; A63B 2069/402
(Continued)

(56) References Cited

U.S. PATENT DOCUMENTS 3,777,732 A * 12/1973 Holloway ..... A63B 69/406 124/78
4,352,348 A * 10/1982 Griffith ..... A63B 69/406 124/78

(Continued)

FOREIGN PATENT DOCUMENTS

GB 2357439 A 6/2001

OTHER PUBLICATIONS

European Patent Office, International Search Report, Application PCT/IB2022/054225, mailed Aug. 16, 2022, 3 pages.

*Primary Examiner* — John E Simms, Jr.
(74) *Attorney, Agent, or Firm* — Ziegler IP Law Group, LLC.

(57) ABSTRACT

A training device for ball sports 1 comprises a launching section 3 comprising a pair of launch wheels 15, the launch wheels 15 having substantially parallel axes of rotation, and an adjustment mechanism 19 configured to adjust the vertical angle of launch of the launch wheels 15; a base section 2 supporting the launching section 3; the base section 2 comprising a base swivel 6 comprising an outer perimeter base 9 sized and shaped to provide a stable contact with the ground or other surface on which the base section 2 is resting, and at least one leg 10 connected to the outer perimeter base 9 and extending upwards to connect with and support the launching section 3 above the ground or other surface, the leg or legs 10 and launching section 3 mutually configured for rotational connection so that the base section 2 can freely swivel in substantially the horizontal plane.

16 Claims, 13 Drawing Sheets

(58) Field of Classification Search
USPC ..... 124/78
See application file for complete search history.

(56) References Cited

U.S. PATENT DOCUMENTS

| | | | | | |
|---|---|---|---|---|---|
| 4,632,088 | A * | 12/1986 | Bruce | A63B 69/406 | 124/78 |
| 5,832,909 | A * | 11/1998 | Grant | A63B 69/406 | 124/6 |
| 6,739,325 | B1 * | 5/2004 | Paulson | F41B 4/00 | 124/78 |
| 9,022,016 | B1 | 5/2015 | Hafer et al. | | |
| 11,719,504 | B1 * | 8/2023 | Kopman | F41B 11/54 | 124/78 |
| 11,724,170 | B2 * | 8/2023 | Hannallah | A63B 47/005 | 124/78 |
| 2009/0057519 | A1 * | 3/2009 | LaPointe | A47C 3/18 | 248/415 |
| 2011/0130226 | A1 | 6/2011 | Alger | | |
| 2013/0109510 | A1 | 5/2013 | Boehner | | |
| 2014/0261363 | A1 * | 9/2014 | Lu | F41B 4/00 | 124/78 |
| 2017/0252630 | A1 * | 9/2017 | Tomlinson | A63B 69/002 | |
| 2021/0260461 | A1 * | 8/2021 | Voloshin | A63B 47/021 | |

* cited by examiner

TRAINING DEVICE FOR BALL SPORTS

FIELD

The present invention relates to a training device for ball sports. More particularly, the present invention relates to a compact, low-weight training device for ball sports that can be easily transported and set up as and where required.

BACKGROUND

Ball sports such as football (soccer) are extremely popular, and are played by organised teams at every level from local club to international. Skillful players are able to control the ball to the extent of adding spin to the ball as well as an initial velocity, so that the ball changes direction or curves while in flight. This is advantageous in many situations—for example, in football this allows a player to make indirect shots, bypassing intervening obstacles in line-of-sight between the player and their target, so that the player can shoot or pass to another player on their team. However, it takes considerable practice for a receiving player to be able to control the ball delivered in this manner, and being able to 'read' a ball (accurately assess flight characteristics while the ball is in flight) is an important aspect of this. In order to be able to practice this, it is useful if a ball is launched at a player in substantially the same manner each time. In a normal training environment a limited number of ball deliveries arrive where they often should from a pass, cross, set piece or shot taken by a player. Under these conditions the density of useful training for the receiving players is low and it can take considerable time for the players to develop their skills such as ball control, finishing and other individual or team attacking and defensive plays.

It is also useful, for example if training a goalkeeper or similar, to be able to shoot balls repeatedly and swiftly, from a variety of angles and at a variety of speeds, so that they can practice their skills such as catching and ball handling, shot stopping, reflexes, positioning and other individual or team attacking and defensive plays.

A number of machines are currently available that have ball launching functionality to allow users to practice specific skills the same as or similar to those outlined above. The Eurogoal machines by Globus Corporation are intended to provide goal shots, crosses and high arching shots, in order to train goalkeepers, defenders and strikers. The Sidekick soccer machine by Seattle Sports Science provides similar functionality, as does the Strikeattack machine by Sportsattack.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

It is an object of the present invention to provide a training device for ball sports which goes some way to overcoming the abovementioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Accordingly, in an aspect the present invention may broadly be said to consist in a training device for ball sports, comprising: a launching section comprising a pair of launch wheels, the launch wheels having substantially parallel axes of rotation, and an adjustment mechanism configured to adjust the vertical angle of launch of the launch wheels; a base section supporting the launching section; the base section comprising a base swivel comprising an outer perimeter base sized and shaped to provide a stable contact with the ground or other surface on which the base section is resting, and at least one leg connected to the outer perimeter base and extending upwards to connect with and support the launching section above the ground or other surface, the leg or legs and launching section mutually configured for rotational connection so that the base section can freely swivel in substantially the horizontal plane.

In an embodiment, the outer perimeter base comprises a substantially circular ring.

In an embodiment, the legs are arranged to extend substantially in parallel across the outer perimeter base each side of the centre of the outer perimeter base.

In an embodiment, the base section comprises a substantially flat plate, at least one travel wheel connected at one side of the plate, and a handle extending from the opposite side of the plate to the travel wheels, the flat plate, wheels and handle configured so that the wheel or wheels are out of contact with the ground or other surface in use, and so that a user can lift the handle to pivot the base section to bring the wheel or wheels into contact with the surface on which the base swivel rests.

In an embodiment, the wheels are mounted so that they have a separation at their closest point of substantially 150 mm.

In an embodiment, the adjustment mechanism and launching section are configured so that the vertical angle of launch of the launch wheels can be altered substantially between −3 degrees to +22 degrees.

In an embodiment, the adjustment mechanism comprises a linear actuator.

In an embodiment, the launching section further comprises a feed frame configured to allow balls to be fed from the rear of the launching section through the launch wheels, and so that balls roll downwards and forwards with substantially the same speed each time.

In an embodiment, the launching section further comprises a feed frame configured to allow balls to be fed from the rear of the launching section through the launch wheels, the feed frame configured so that balls enter the feed frame in a substantially vertical direction, and exit into the wheels in a substantially horizontal direction.

In an embodiment, the launching section comprises a framework of struts curving from the vertical to the horizontal.

In an embodiment, the feed frame and wheels are configured so that balls exiting the feed frame contact the wheels at substantially the mid height of the balls.

In an embodiment, the training device for ball sports further comprises a ball feed, the ball feed comprising a tubular framework formed into a curved tube, the inner end of the ball feed and outer/top end of the feed frame configured for mutual connection, the curved tube of the ball feed curving backward and downward toward the horizontal when connected to the feed frame.

In an embodiment, the curved tube of the ball feed curves through substantially 40 degrees.

In an embodiment, the mutual connection between the ball feed and feed frame is via a key hole lock mechanism.

In an embodiment, the ball feed is sized so that up to six regulation-size balls can be stored within the ball feed.

In an embodiment, the ball feed, launching section, and base section are configured so that the ball entry for the ball feed is substantially 1.3 metres from ground level in use.

In an embodiment, a plurality of solenoids are mounted at or towards the lower end of the ball feed, located so that when in a non-activated state, the solenoids extend into the ball feed to prevent the passage of balls out of the lower end of the ball feed, and that when activated, the solenoids move outwards to allow only one ball at a time to pass through the lower end of the ball feed.

In an embodiment, the solenoids comprise a pair of solenoids located at substantially diametrically opposed positions.

In an embodiment, the launch wheels comprise semi-hollow cylinders having a circumferential outer rim, a central connection hub, and a plurality of radial spokes, the launch wheels having a height of substantially 100 mm.

In an embodiment, the training device for ball sports further comprises an outer grip layer at least partly covering the circumferential outer surface of the circumferential outer rim.

In an embodiment, the thickness of the circumferential outer rim portion 37 is substantially 5 mm and the grip layer comprises rubber having a thickness of substantially 13 mm, so that the diameter of the wheel is substantially 170 mm. In an embodiment, the rubber layer comprises a PBR rubber layer of Shore Hardness 50A.

In an embodiment, each wheel further comprises an outer ring surrounding and spaced from the central connection hub, the hub and outer ring connected to the outer rim via the radial spokes, the hub circular in plan view, with a central, circular aperture having a square or rectangular cut-out formed at one side.

In an embodiment, every second one of the spokes runs through the outer ring to connect with the hub.

In an embodiment, the outer ring is configured with four inwardly-facing indents at substantially equal intervals, directly adjacent to spokes.

In an embodiment, there are six spokes spaced at substantially equal angular intervals.

In an embodiment, the training device for ball sports further comprises a control system and plug-in unit, the control system and plug-in unit configured so that the plug-in unit can be connected to and removed from the training device, the training device limited to operating in a restricted mode below full power when the plug-in unit is removed.

In an embodiment, the training device is limited to substantially 53% power without the plug-in unit connected.

In a second aspect the present invention may broadly be said to consist in a launch wheel for a training device for ball sports comprising a semi-hollow cylinder having a circumferential outer rim, a central connection hub, an outer ring and a plurality of radial spokes, the outer ring surrounding and spaced from the central connection hub, the hub and outer ring connected to the outer rim via the radial spokes.

In an embodiment, the hub is circular in plan view, with a central, circular aperture having a square or rectangular cut-out formed at one side.

In an embodiment, the launch wheel has a height of substantially 100 mm.

In an embodiment, the launch wheel further comprises an outer grip layer at least partly covering the outer surface of the circumferential outer rim.

In an embodiment, the thickness of the circumferential outer rim portion is substantially 5 mm and the grip layer comprises rubber having a thickness of substantially 13 mm.

In an embodiment, the outer rubber layer comprises a PBR rubber layer of Shore Hardness 50A.

In an embodiment, the overall diameter of each wheel is substantially 170 mm.

In an embodiment, every second one of the spokes runs through the outer ring to connect with the hub.

In an embodiment, the outer ring is configured with four inwardly-facing indents at substantially equal intervals, directly adjacent to spokes.

In an embodiment, there are six spokes spaced at substantially equal angular intervals.

In a second aspect the present invention may broadly be said to consist in a method of manufacturing a launch wheel for a training device for ball sports comprising the steps of:

i) extruding a length of aluminium as a single unitary item with the desired cross-section ii) cutting launch wheel bodies of the required wheel height from the extruded length.

In an embodiment, the required wheel height is substantially 100 mm.

In an embodiment, the method of manufacturing a launch wheel further comprises the step of:

iii) adding an outer grip layer at least partly covering the outer surface of the launch wheel.

In an embodiment, the grip layer comprises rubber having a thickness of substantially 13 mm.

In an embodiment, the outer rubber layer comprises a PBR rubber layer of Shore Hardness 50A.

In an embodiment, the overall diameter of each wheel is substantially 170 mm.

In an embodiment, the desired cross section comprises a semi-hollow cylinder having a circumferential outer rim, a central connection hub, an outer ring and a plurality of radial spokes, the outer ring surrounding and spaced from the central connection hub, the hub and outer ring connected to the outer rim via the radial spokes.

In an embodiment, the hub is circular in plan view, with a central, circular aperture having a square or rectangular cut-out formed at one side.

In an embodiment, every second one of the spokes runs through the outer ring to connect with the hub.

In an embodiment, the outer ring is configured with four inwardly-facing indents at substantially equal intervals, directly adjacent to spokes.

In an embodiment, there are six spokes spaced at substantially equal angular intervals.

With respect to the above description then, it is to be realised that the optimum dimensional relationships for the parts of the invention, to include variations in size, weight, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which.

DETAILED DESCRIPTION

An embodiment of a training device for ball sports of the present invention will now be described with reference to the figures.

The training device 1 of this embodiment is intended for use with footballs (that is, soccer balls), for the practice of soccer skills. However, it should be noted that the scope of the invention is not limited to soccer, and that other embodiments could be used for other ball sports without departing from the scope of the invention.

Figure 1:
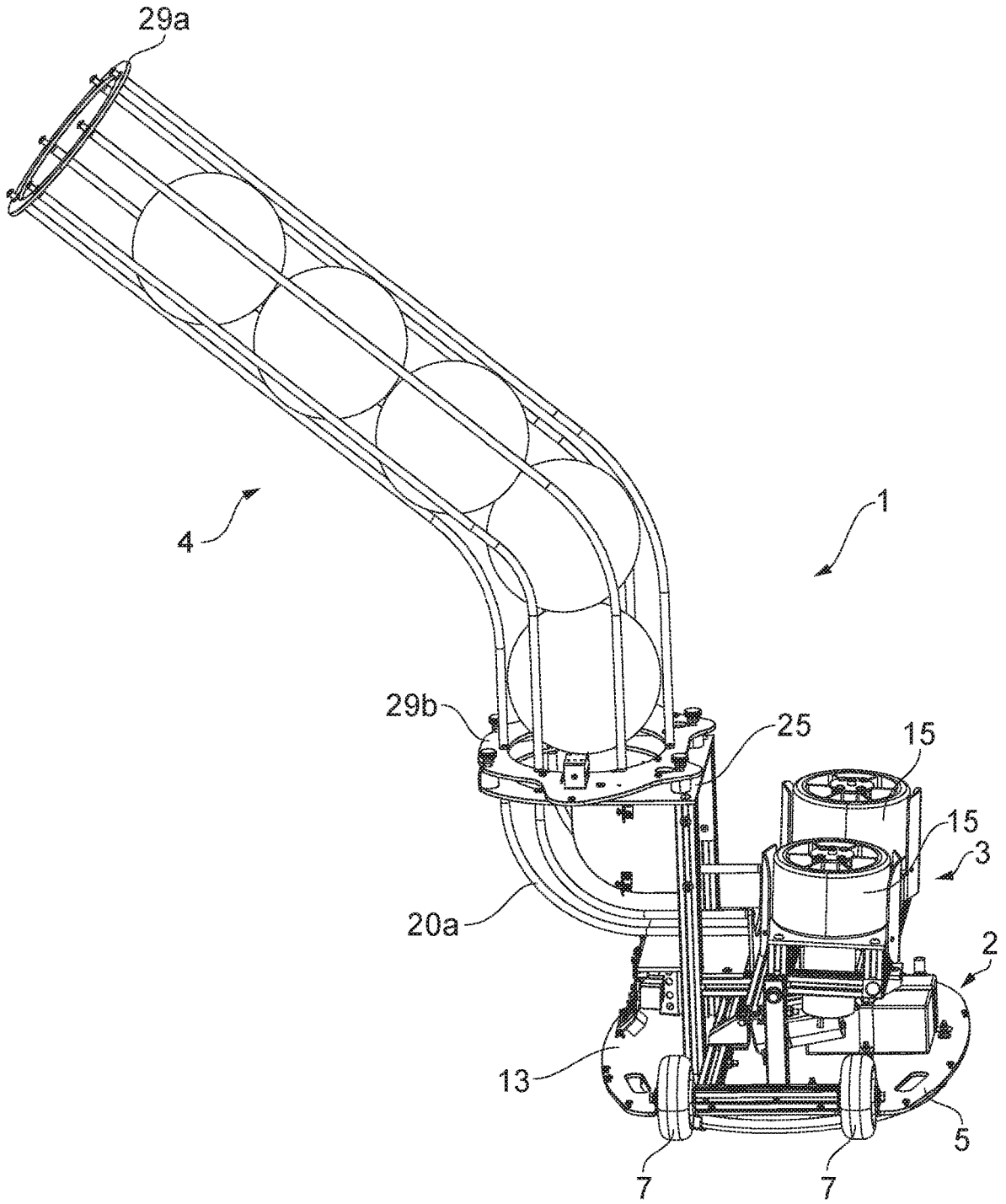
FIG. 1 shows a perspective from one side and slightly above of a training device according to an embodiment of the invention with it's cover removed to show detail of the internal structure, the training device having a base section, a launching section, and a ball feed, the base section having a swivel that allows full rotation from side to side and wheels and a handle for transport, the ball feed shown connected in position and loaded ready for use.
Figure 2:
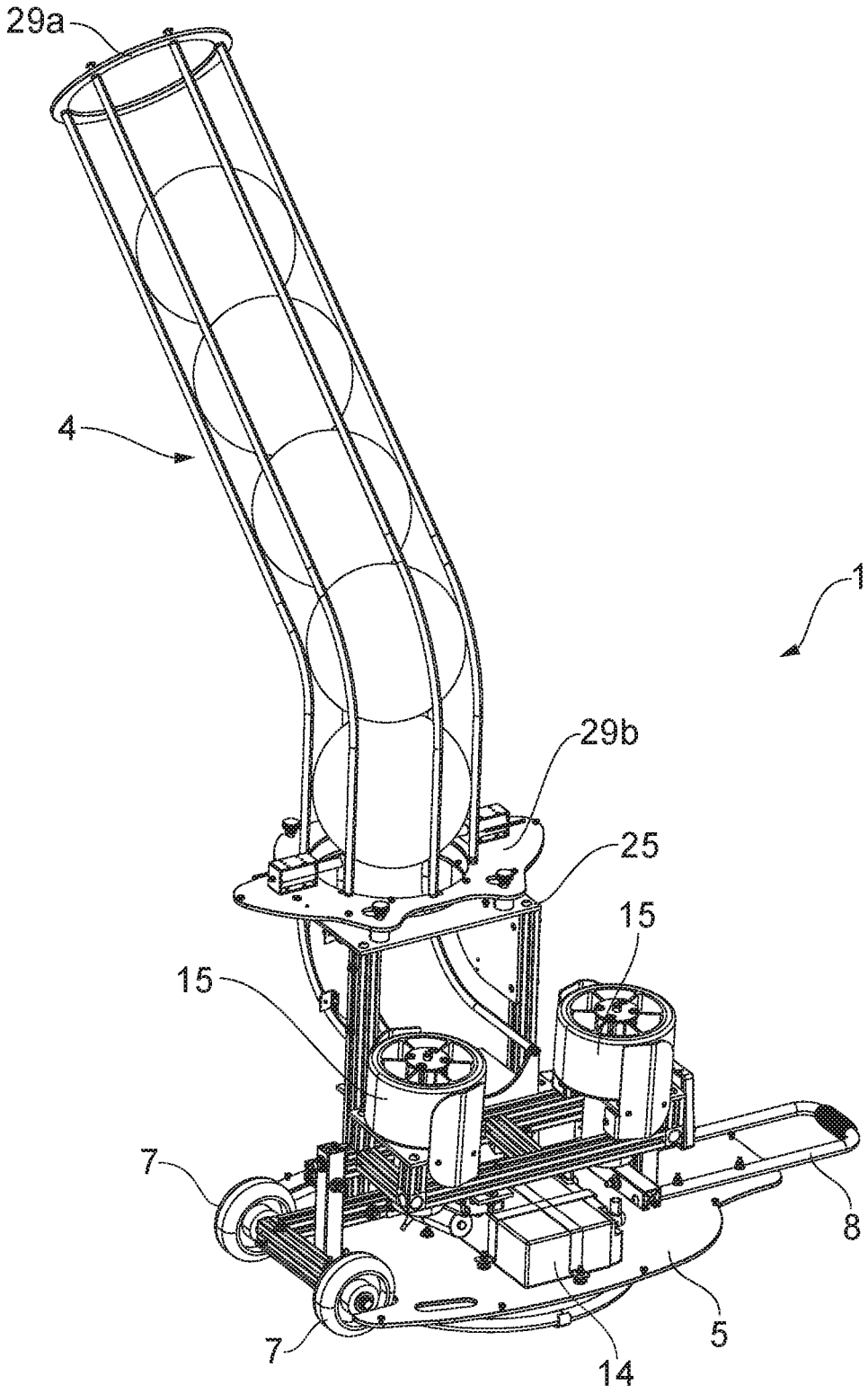
FIG. 2 shows a perspective view from the front and slightly to one side of the training device of FIG. 1.
Figure 3:
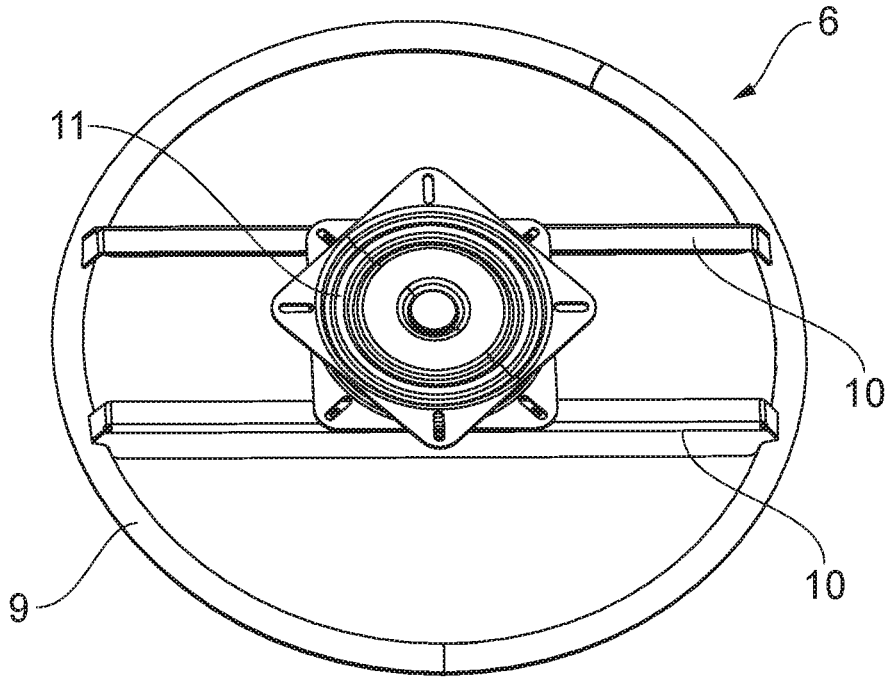
FIG. 3 shows a perspective top view of the swivel of the training device, separated from the training device, the swivel having an outer ring, support legs extending radially inwards and upwards from the ring, a support platform, and a central connection mechanism, the support platform rotating freely in relation to the ring and legs, in the same plane as the ring.

As shown in FIGS. 1 and 2, the training device 1 has three main parts: a base section 2; a launching section 3, and a ball feed 4. These are described in detail below.

Base Section

The base section 2 comprises a base plate 5, a base swivel 6, transport or travel wheels 7 and a handle 8.

The base plate 5 comprises a flat plate having the general overall appearance in plan view of an oval with cut-off ends, and an elongate extension extending outwards from one of the cut-off-ends, the longer edges of the oval in use aligned to the front and rear of the training device. In the preferred embodiment, the base plate 5 is formed from a composite board material. The base swivel 6 is connected to the underside of the base plate 5, with an axis of rotation substantially at the centre of the base plate 5, as described in detail below. The travel wheels 7 comprise a pair of wheels of the same general type as caster wheels used on suitcases, shopping trolleys or similar. The travel wheels 7 are connected at the flat, cut-off end of the base plate 5, and are connected and angled on the base plate 5 such that when the training device 1 is resting on the base swivel 6 and ready for use, the travel wheels 7 are clear of the ground or other surface on which the training device 1 is resting. The handle 8 is located at the opposite end from the wheels 7, at the extension end of the base plate 5. In the embodiment shown, the handle 8 is fixed. However, in alternative embodiments, this can be a telescoping handle that can telescope inwards by passing/moving across the top of the base plate 5 in substantially the same plane as the base plate 5, and which can telescope out from the base plate 5 to extend from the base plate 5 in substantially the same plane as the base plate 5.

A user can grasp and lift the handle 8 to lift and tilt the training device 1 onto the wheels 7 at the opposite end to the handle 8, the wheels 7 arranged so as to contact the floor when the handle 5 is fully extended and gripped by a user at around hip level or slightly lower, allowing the training device 1 to be wheeled around for transport purposes. The base plate 5 also includes two lifting apertures 36 towards the sides, at the opposite end from the handle. The lifting apertures 36 allow a two-person lift of the training device 1.

The swivel 6 comprises an outer ring 9 or perimeter base shape 9, sized and shaped to provide a stable contact with the ground or other surface on which the swivel is resting. The swivel 6 is formed from steel or a similar material, coated or painted as required to avoid corrosion. The ring 9 in this embodiment is formed as a circular hoop, the body of the hoop being circular in cross-section. The ring 9 has an outer diameter of substantially 465 mm, and an inner diameter of substantially 426 mm.

Legs 10 extend inwards and upwards to a support platform 11 having a central connector 12. The support platform 11 is connected on top of the support legs 10, at the apex of the legs 10, and can freely rotate relative to the outer ring 9 and legs 10 around an axis of rotation centred on the central connector 12, at the centre of the circle formed by the ring 9. In use, the outer ring 9 rests on a surface such as the ground, and the support platform 11 is supported above this, rotating freely in relation to the outer ring 9 and legs 10. The base plate 5 is located above this, connected to the central connector 12 at a substantially central point on the base plate 5, so that the base plate 5 and the elements mounted thereon can freely rotate from side-to-side around a 360-degree arc/circle. The legs 10 are arranged in parallel to run each side of the support platform 11, spaced apart a distance of substantially 124 mm. This ensures that the weight load is spread to the outer ring 9 while a central point of weight is maintained—that is, the device will not tip, in any position of rotation. 'Ring' as used in this specification should be taken to mean that the outer perimeter base shape could have any suitable shape, such as oval or ellipse-shaped, square, rectangular, hexagonal, etc.

Launching Section

The launching section 3 is mounted on the top of the base plate 5, and comprises a mounting frame 13, a launch frame 18, a power source 14, a feed frame 20, an adjustment mechanism 19, and a pair of launch wheels 15.

In the preferred embodiment, the mounting frame 13 comprises two side legs 16 arranged substantially along and towards the ends of the long bisecting axis of the base plate 5, and a crossbar 17 running between and connected to the side legs 16, the crossbar 17 horizontal and located a short distance above the base plate 5. The upper ends of the side legs 16 extend slightly above the top of the crossbar 17. The legs 16 and crossbar 17 are in the preferred embodiment formed from extruded aluminium, but could be formed from steel, plastic or any other suitable material.

The launch frame 18 comprises a substantially rectangular frame that is formed, in the preferred embodiment, from extruded aluminium. The rear long edge of the adjustment frame 18 locates between the top ends of the legs 16, running above and in parallel with the crossbar 17 below this. The rear corners of the adjustment frame 18 are pivotally connected to the upper ends of the legs 16, so that the adjustment frame 18 can rotate up and down about an axis of rotation that is above and in parallel with the crossbar 17. Wheel mount subassemblies 22 are located at the front corners of the frame 18, extending upwards from the frame 18, these having the general form of cuboid frame outlines configured to allow the launch wheels 15 and their associated motors 21 to be mounted to the launch frame 18.

The launch wheels 15 and associated wheel motors 21 are mounted to the launch frame 18 above and inside and towards the front corners of the adjustment frame 18, via the wheel mount subassemblies 22. The wheels are mounted so that they are 150 mm apart at their closest point—where the circumferences of the wheels are closest to one another. The launch wheels 15 are located above the launch frame 18, with the motors 21 extending downwards through the wheel mount subassemblies 22 and the plane of the frame.

Figure 12:
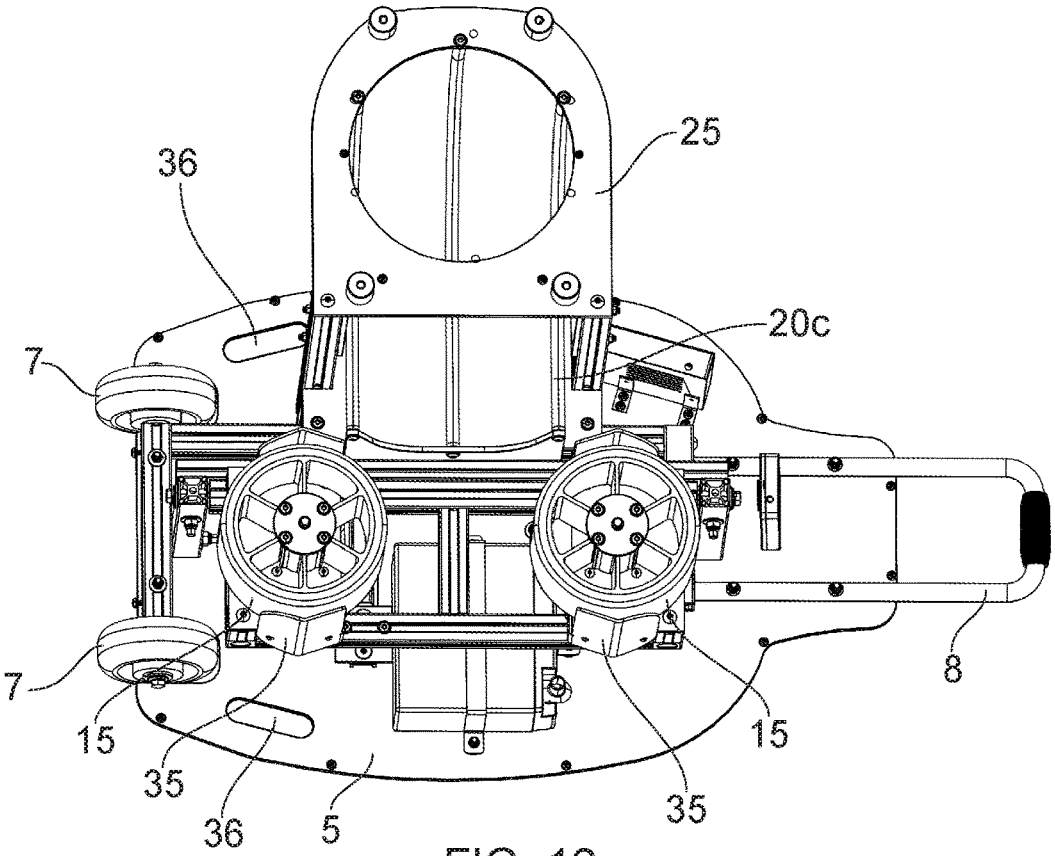
FIG. 12 shows a plan view of the embodiment of training device shown in FIGS. 1 to 3 with the ball feed detached and not present.

As shown in FIG. 12, in the preferred embodiment wheel guards 35 are positioned in front of each wheel 15. The wheel guards 35 comprise plastic plates that are connected to and which extend upwards from the launch frame 18 in front of each wheel 15. This manages the risk of user entanglement with the device when it is operational.

As can be seen from the figures and the above description, the launch frame 18 extends forwards and above the front part of the base plate 5. The adjustment mechanism 19, which in this embodiment comprises a linear actuator, connects between the front edge of the launch frame 18, and the base plate 5, connected in such a manner that linear movement of the linear actuator's arm causes a push-pull movement on the front of the launch frame 18, and therefore rotation of the frame 18 around the pivot points on the legs 16. This allows easy and consistent adjustment of the ball firing height or vertical angle of launch (the angle in the vertical plane at which the balls are launched) over a range from substantially −3 to substantially +22 degrees.

The power source 14 in the preferred embodiment comprises a battery. In the preferred embodiment, the battery is a 12V battery, located at the front of the plate 5, under the launch frame 18. The power source 14 provides power for the training device 1.

Figure 4:
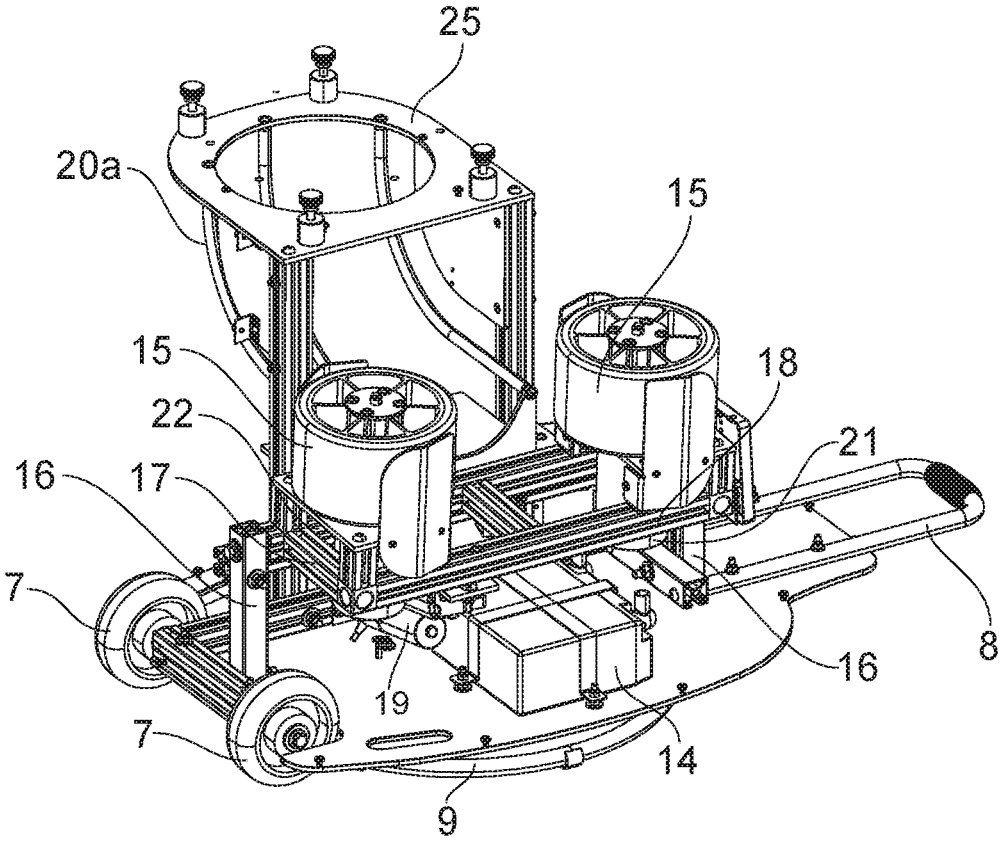
FIG. 4 shows a close-up perspective front view of the embodiment of training device shown in FIGS. 1 to 3 with the ball feed detached and not present, showing detail of the launching section which comprises a static or fixed frame, a wheel adjustment frame that is pivotally connected to the fixed frame, an adjustment mechanism connected between the base plate and the adjustment frame to move the adjustment frame relative to the fixed frame and base plate, a power supply, and a pair of launching wheels and their associated motors mounted to the adjustment frame.
Figure 5:
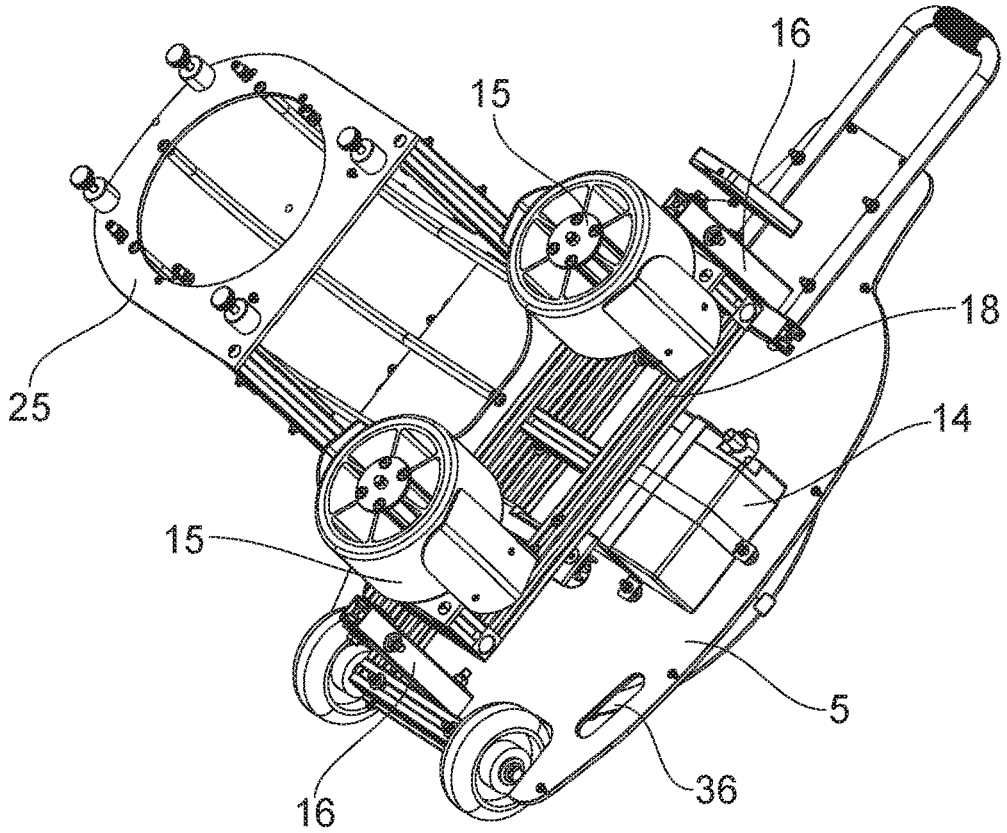
FIG. 5 shows a front-top perspective view of the embodiment of training device shown in FIGS. 1 to 3 with the ball feed detached and not present, showing detail of a feed frame portion of the launching section, located at the rear of the base section behind the wheel adjustment frame.
Figure 6:
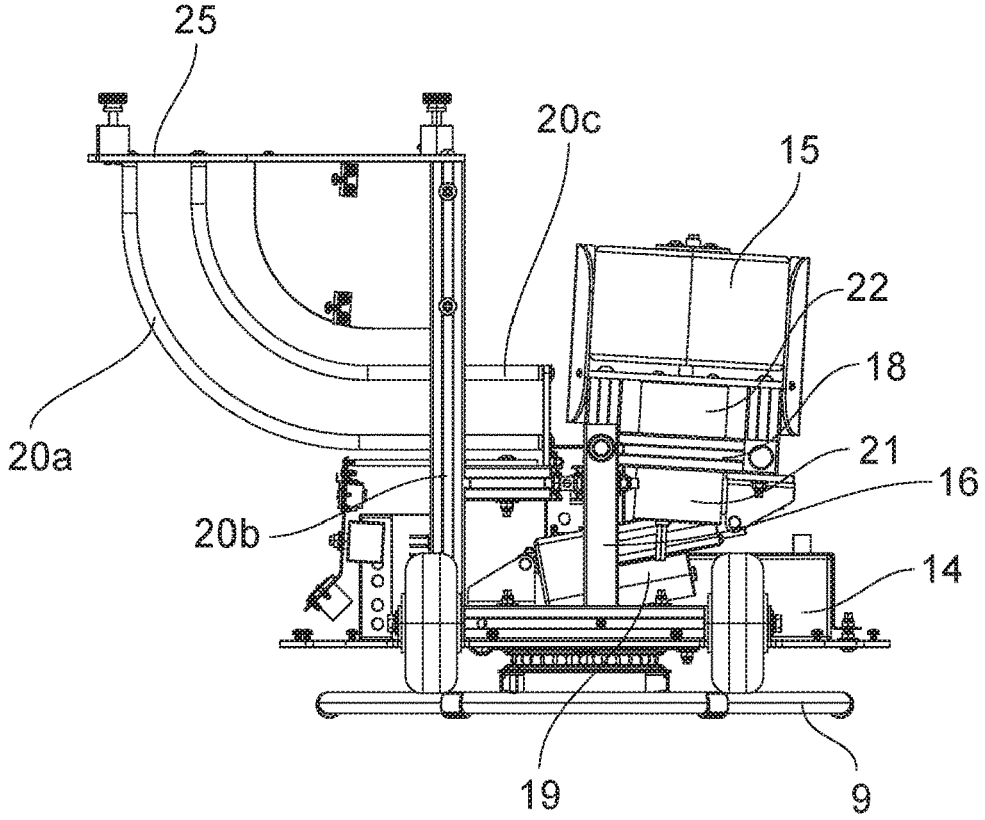
FIG. 6 shows side view of the embodiment of training device shown in FIGS. 1 to 3 with the ball feed detached and not present, showing further detail of a feed frame portion of the launching section, located at the rear of the base section, behind the wheel adjustment frame.

In an embodiment, the battery forms the power source 14, and is mounted to the plate, as shown in FIGS. 4, 5, and 6.

In an alternative embodiment, as shown in FIGS. 14 to 18, the battery is contained within a box, with the box mounted on the plate. While the battery is the only element that provides power, the battery 114*a* and box 114*b* together can be considered to be the 'power source'.

The box 114*b* contains cables 200 that connect between the battery 114*a* and a female connector 201 mounted on the wall of the box. The female connector 201 corresponds to male connector 202 located on the launching section 3, the male and female connectors 201, 202 connected in use so that power is provided for the training device 1.

In use, the box 114*b* is bolted to the base plate 5 via u-shaped connectors 203 extending upwards from the surface of the base plate 5, and corresponding butterfly bolts 204 integral with the sides of the box 114*b*.

The power source (box/battery) can easily be removed for ease of charging. In addition, once the power source is removed from device, this lightens the remainder of the device (plate 5, launch frame 18, etc), which can help with transportation. The removable power source also means that customers can have access to more than one, which allows these to be swapped out during a training session thus extending the length of the training sessions before all the sources are drained and recharging is required.

As shown in the figures, and with particular reference to FIGS. 5 and 6, the feed frame 20 is located at the rear of the base plate 5, and comprises a framework structure where balls enter a framework tube 20*a* aligned so the balls initially travel vertically, before passing along the framework tube 20*a* around a 90-degree curve from vertical to horizontal, the balls then exiting the feed frame to enter the gap between the launching wheels 15, the ball contacting the wheels 15 so that these launch the ball through the gap between the launch wheels 15.

Figure 7A:
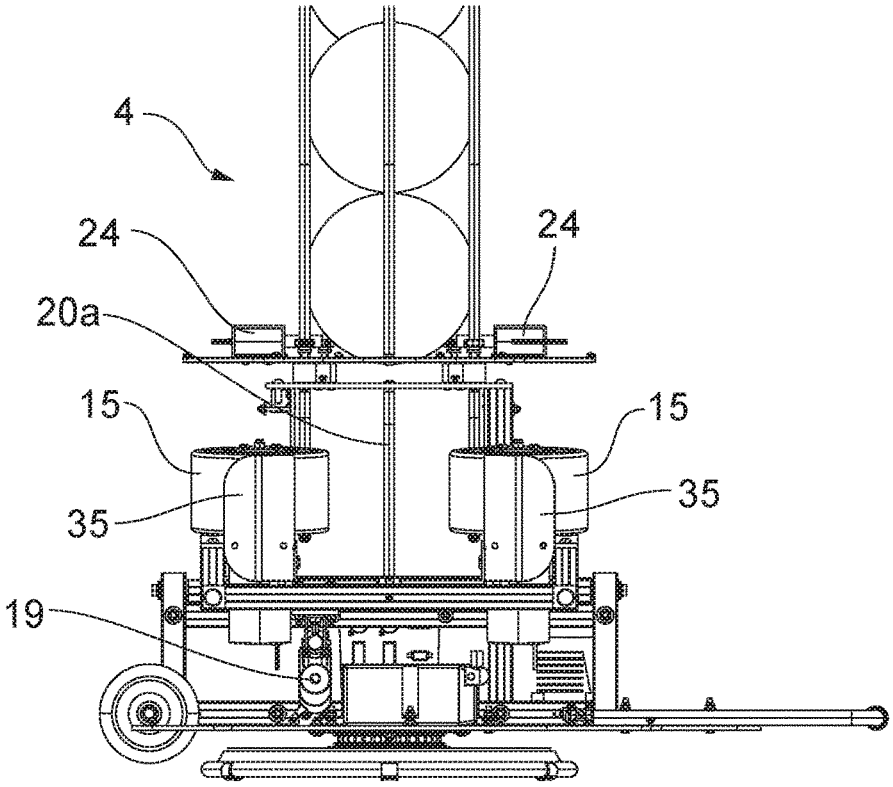
FIG. 7*a* shows a view from the front of the embodiment of training device, looking rearwards through the gap in the launch wheels, showing the upper part of the feed frame and the lower part of the ball feed.
Figure 7B:
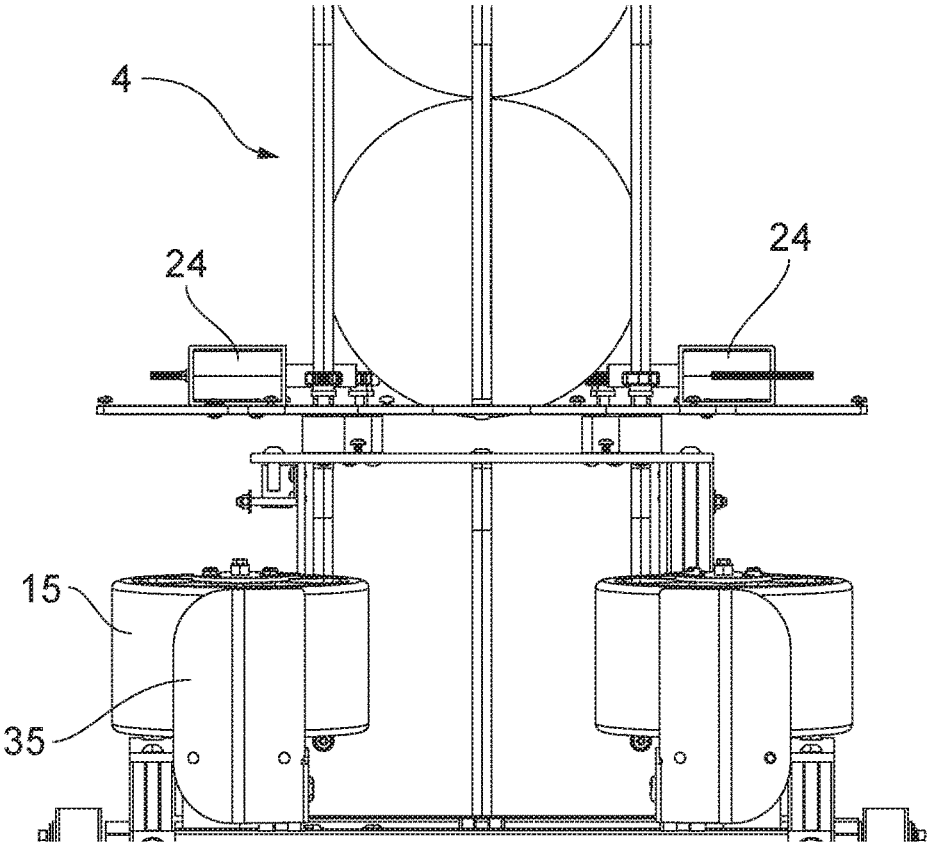
FIG. 7*b* shows a closeup view from the same angle as FIG. 7*a* of the upper part of the feed frame and the lower part of the ball feed, showing detail of a pair of solenoids mounted at the lower end of the ball feed, the solenoids located on diametrically opposed sides, the moving or active part of each of the solenoids moving inwards and outwards a short distance so that movement of a ball through the tube is prevented in the inwards position, and in the outwards position the balls can pass freely along the passage.

The feed frame 20 is connected to the base plate 5 at the rear edge of the base plate 5, with the support section 20*b* of the feed frame 20 connected to the rear edge of the base plate 5 and extending upwards, the majority of the curved framework tube 20*a* extending rearwardly from the rear edge of the base plate 5, a small portion or internal feed 20*c* extending forwards to just short of the gap between the launch wheels 15, the internal feed 20*c* substantially semi-circular viewed end-on or front-on, and the same or of slightly larger radius than the ball with which it is used. As shown in FIG. 6, the launch wheels 15 are located just above and forwards of the internal feed 20*c*. In this way, balls travelling down the framework tube 20*a* and then along the internal feed 20*c* will contact the launch wheels at their mid-height. A front view of this arrangement is shown in FIG. 7.

The shape of the feed frame 20 allows balls to roll downwards and forwards with the same or substantially similar speed every time, regardless of ball size (regulation FIFA football/soccer balls have three main sizes—sizes 3, 4 or 5). This is achieved by the use of the curved struts that form the framework tube 20*a*, which curve from the vertical to the horizontal. This permits the consistent and repeated delivery of the football/soccer ball to the entry position between the wheels 15, at substantially constant or the same speed each time.

The specific position of the feed frame 20 also allows a ball such as a football/soccer ball to connect and engage with the launch wheels 15 consistently, regardless of the orientation of the launch frame 18. This enables the consistent and repeated delivery of the football/soccer ball.

The rear outer end of the top of the framework tube 20*a* comprises a flat, horizontally aligned ring or top plate 25, having a central ball-sized aperture. The top plate 25 allows attachment of the ball feed 4 as will be described below.

Launch Wheels

Figure 8:
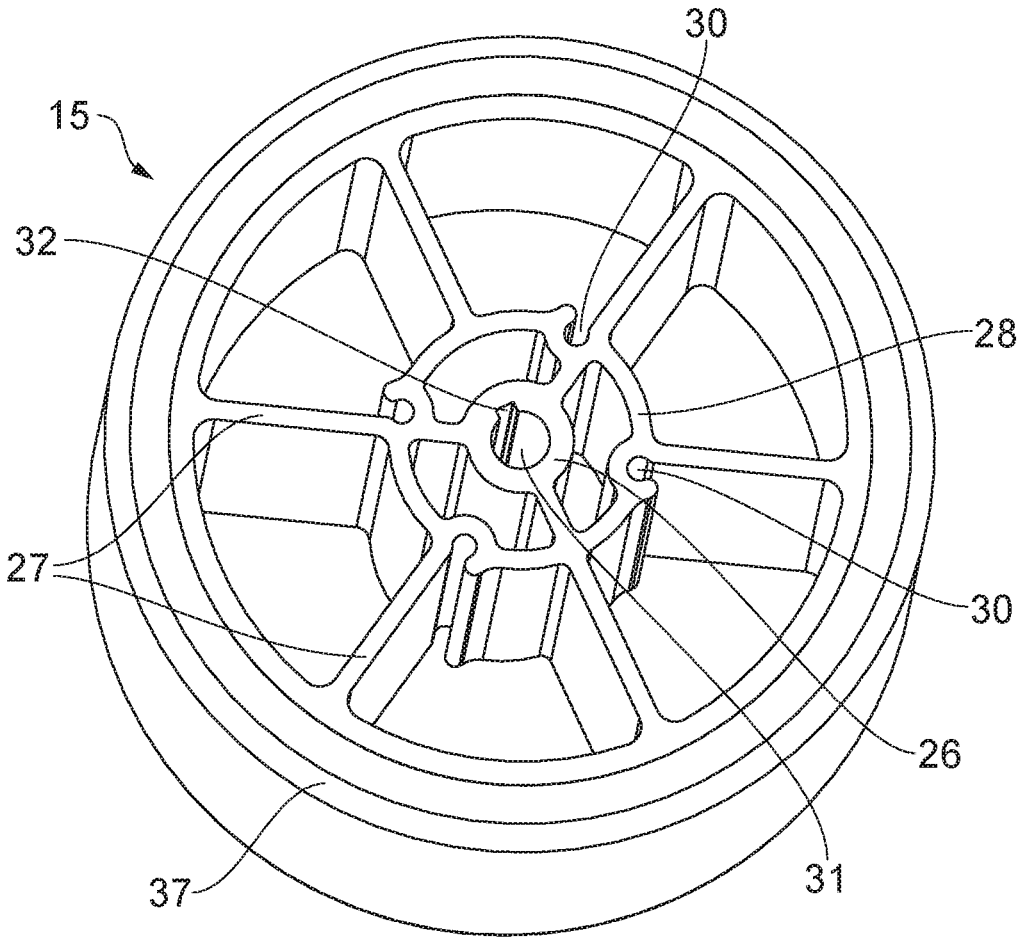
FIG. 8 shows a perspective end view of a launch wheel according to an embodiment of the present invention.
Figure 9:
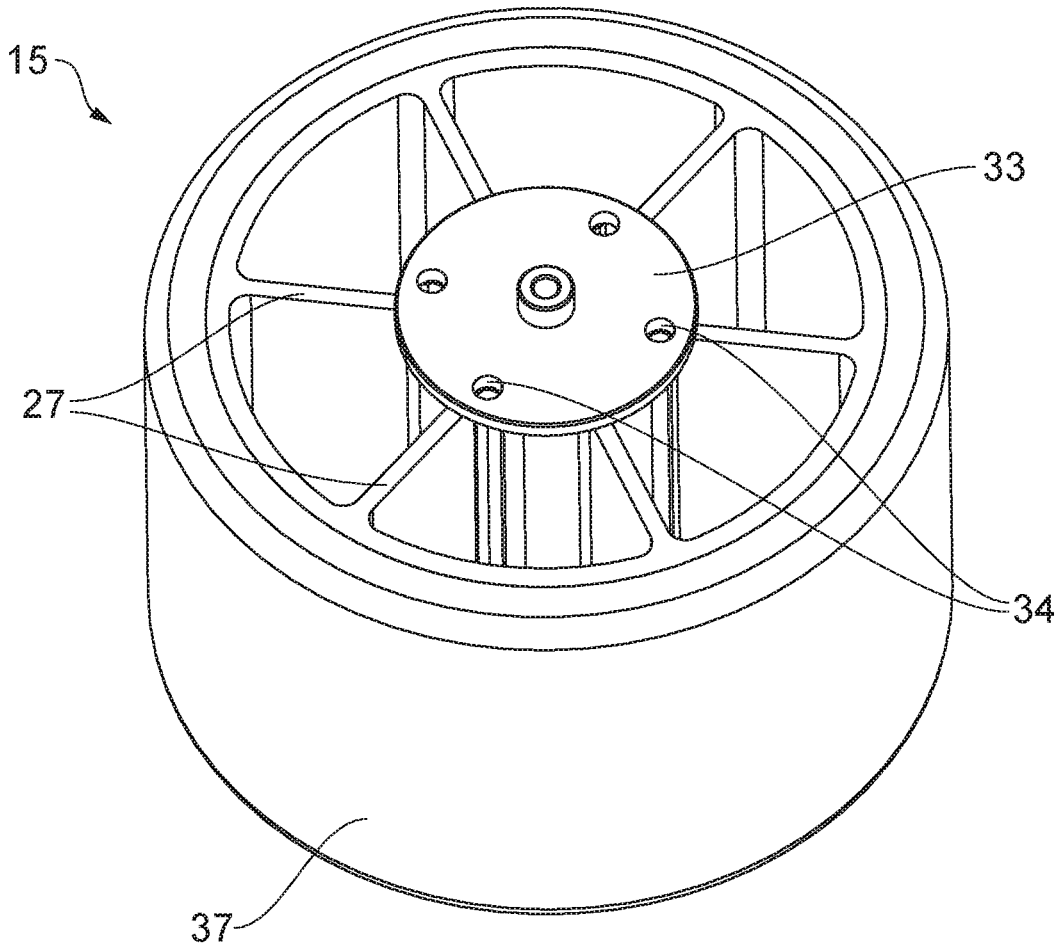
FIG. 9 shows a perspective side view of the embodiment of launch wheel according to the present invention, with a coupler fitted to the wheel at the hub of the wheel.
Figure 13:
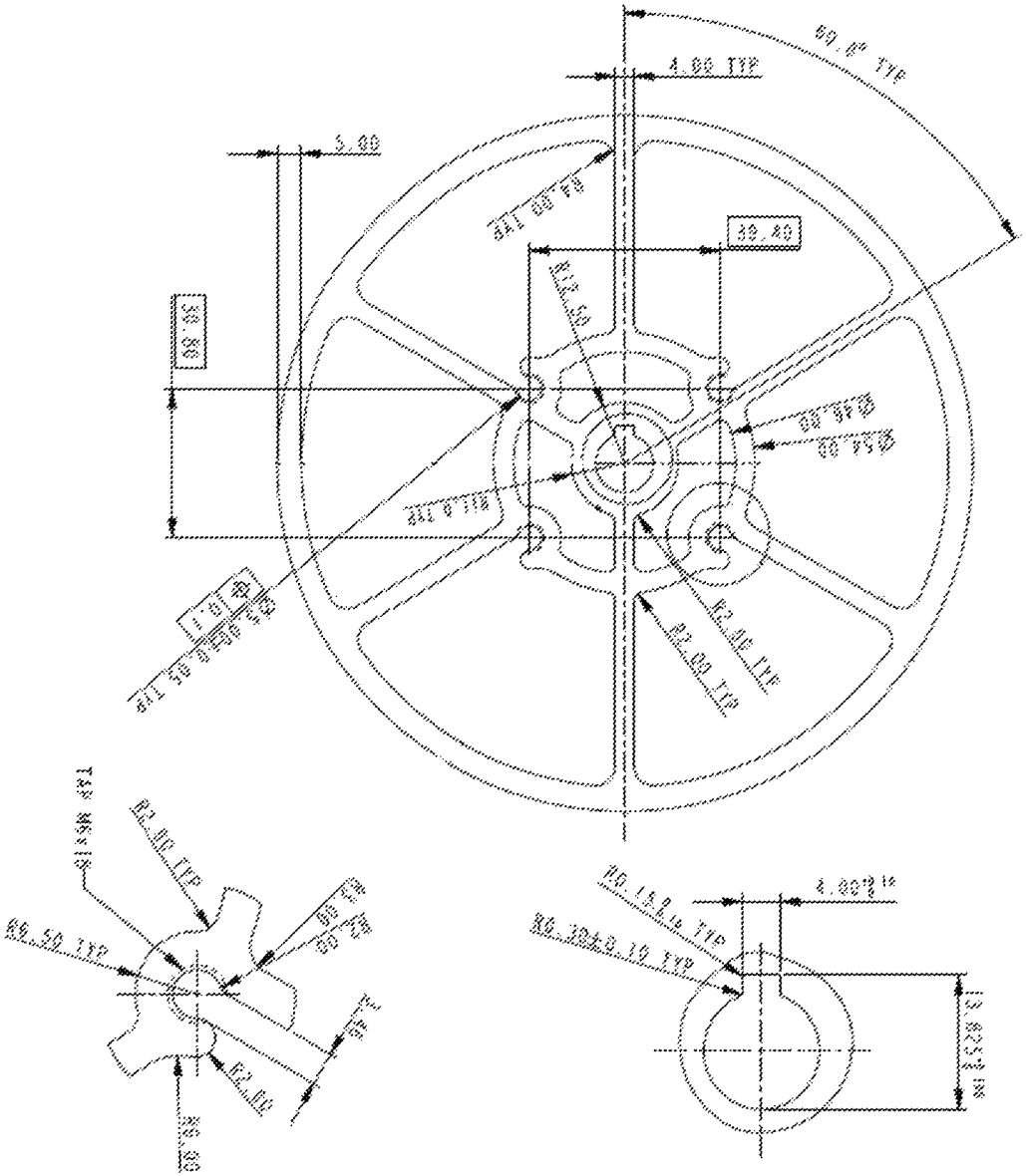
FIG. 13 shows a plan view of a launch wheel according to FIGS. 8 and 9, showing detail of the dimensions of a circumferential outer rim portion, a central connection hub, and an outer ring surrounding and spaced from the hub, with the hub and outer ring connected to the outer rim portion via radial spokes or splines.
Figure 14:
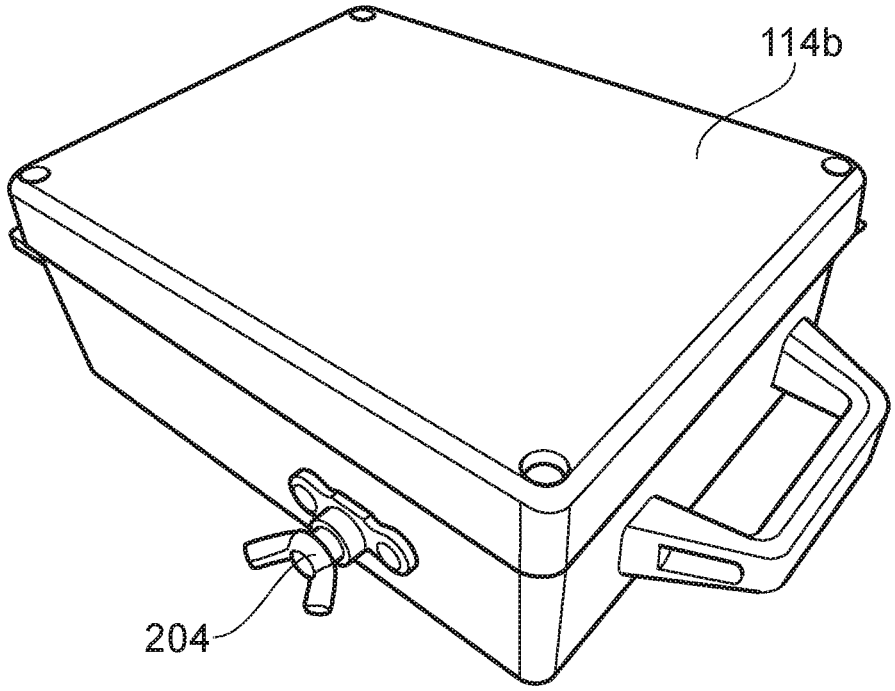
Figure 15:
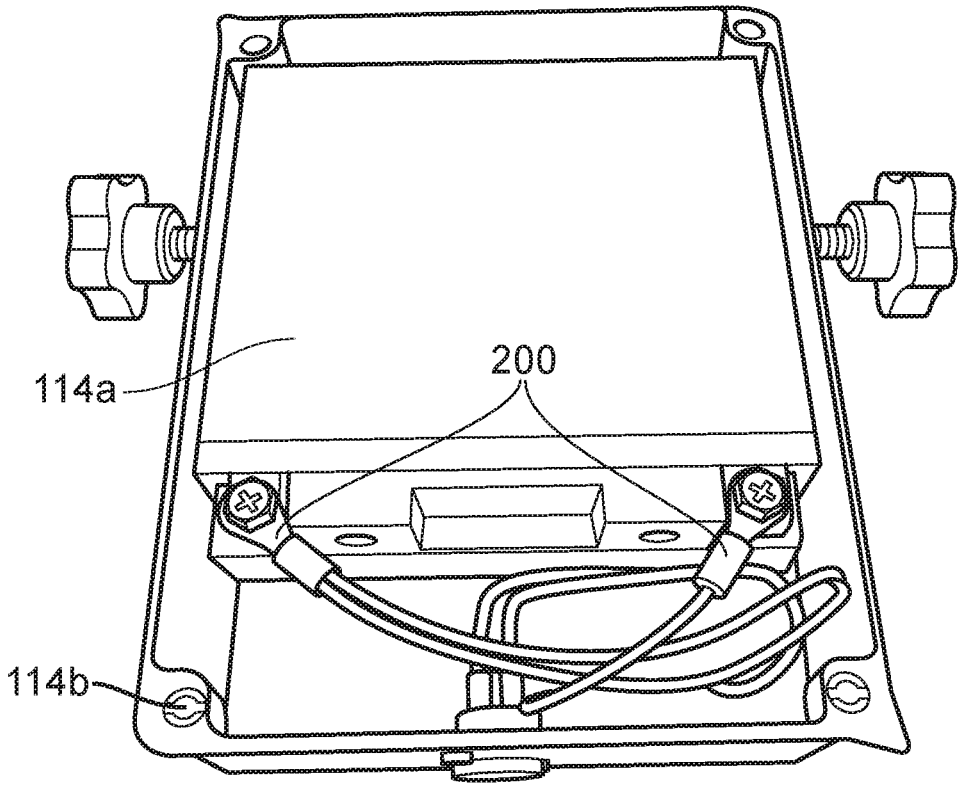
Figure 16:
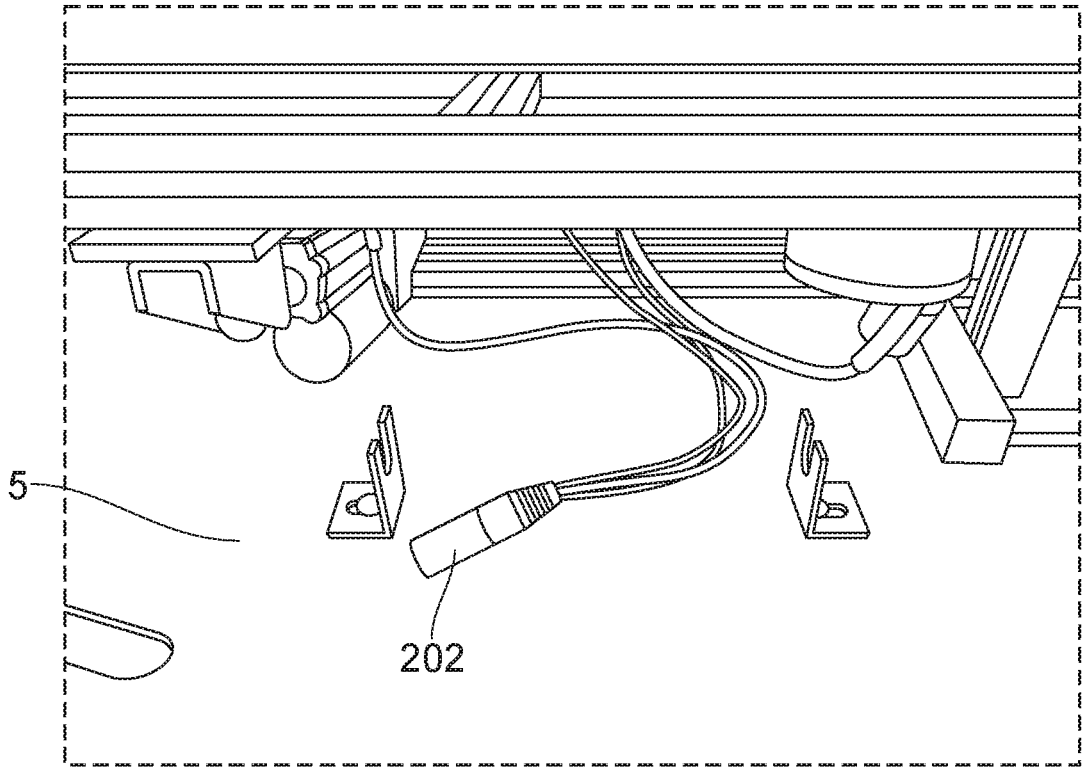
Figure 17:
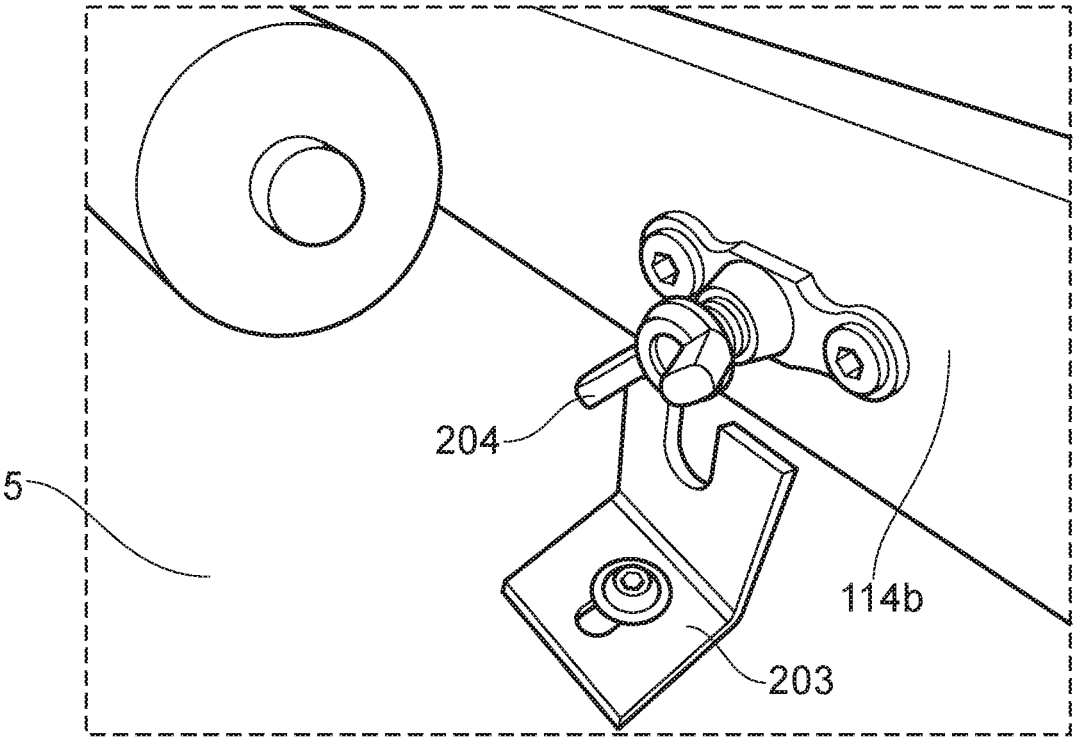
Figure 18:
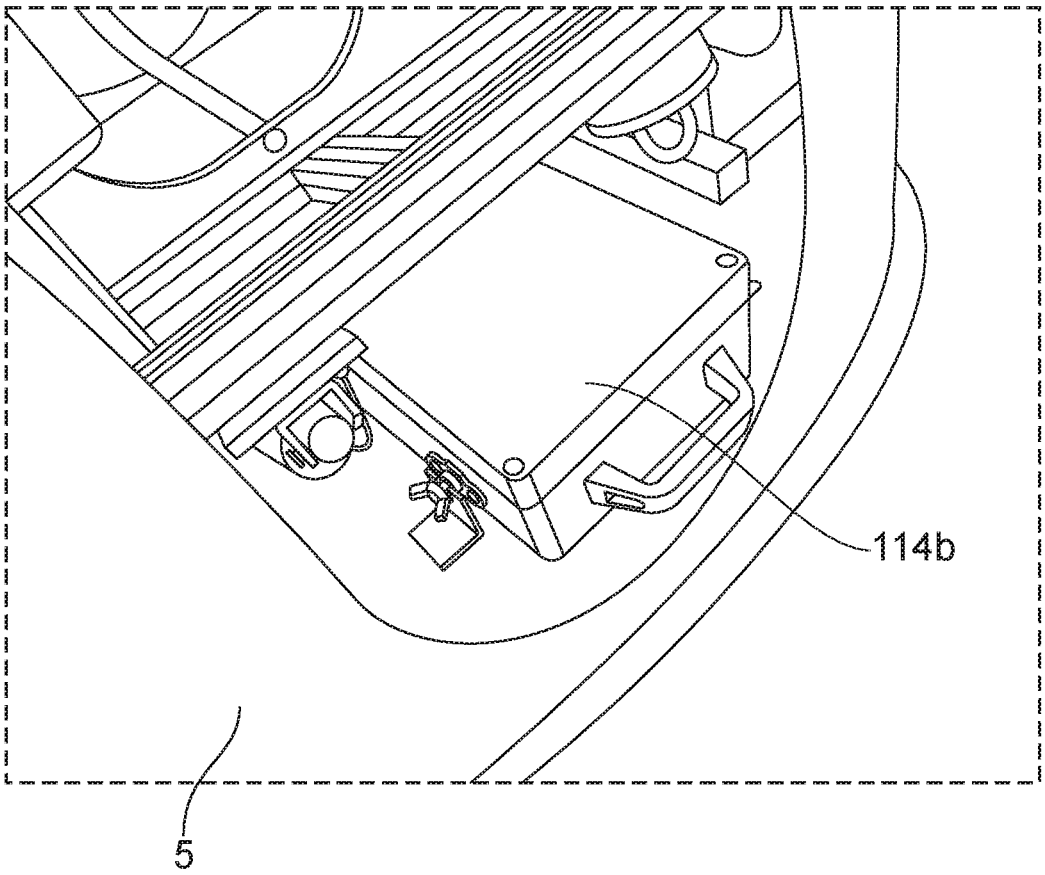

The launch wheels 15 are shown in detail in FIGS. 8, 9, and 13. The dimensions of the preferred form of wheel are shown in detail in FIG. 13.

The wheels 15 are formed as semi-hollow cylinders or rings having a circumferential outer rim portion 37, a central connection hub 26 at the hub to allow them to be connected to the output shaft of a motor, and a mid-ring 28 surrounding and spaced from the hub 26. The hub 26 and mid-ring 28 are connected to the outer rim portion 37 via radial spokes or splines 27. The launch wheels 15 are a single unitary item, formed from aluminium, and are manufactured by extruding a long length of material with the desired cross-section (as shown in FIGS. 8 and 13), and then cutting this to the required size/length (wheel height). In this embodiment, the thickness of the circumferential outer rim portion 37 is substantially 5 mm.

In the preferred embodiment, the launch wheels 15 have a height of substantially 100 mm. This ensures that all regulation football sizes connect with the launch wheels at the ball mid-point after passing through the feed frame. This helps to maximise the grip on the football and provide consistent football delivery.

The total diameter of the launch wheels is substantially 170 mm, including an outer rubber layer (as detailed below) in order to maximise ball surface area contact, and achieve the desired 150 mm ball gap between the launch wheels when the launch wheels are secured in position on the launch frame. 150 mm is the optimum distance between the launch wheels to enable accurate and consistent ball delivery for regulation size 3, 4 and 5 footballs. The diameter of each launch wheel 15 without the outer rubber layer is 144 mm.

This extruded design optimises strength and minimises the weight of each launch wheel to be under 2 kg including the outer rubber layer. The design also allows the mass manufacture of the wheels 15 in a simple and cost-effective manner.

The hub 26 is circular in plan or end view, with a central, circular opening or aperture 31 running through the hub. A square or rectangular cut-out is formed at one side. The aperture and cut-out act to allow the wheel to be located onto an output shaft and held in rotational position on the shaft by an extension from the side of the shaft.

The hub aperture 31 is connected to the outer rim portion 37 via radial spokes or splines 27. The spokes 27 run the full height of the wheel. In the preferred embodiment there are six spokes 27 spaced at substantially equal angular intervals of substantially 60 degrees between each spoke. The connection between each spoke and the outer rim portion is radiused, this radius dimension being approximately 4 mm. The thickness of each of the spokes is substantially 4 mm.

The inner ring of material that forms the hub 26 is surrounded by a second generally circular ring of material (mid-ring 28) that runs around the inner ring/hub 26, spaced from the hub 26. Every second one of the spokes 27 runs through the mid-ring 28 to connect with the hub 26, as shown in FIG. 8*a*.

The mid-ring 28 has four inwardly-facing indents 30 at equal intervals, directly adjacent to the spokes 27. These allow a circular shaft coupler 33 to be connected to the top of the wheel 15, the shaft coupler 33 having a central screw aperture whose centre is fully coincident with the hub aperture 31 when the shaft coupler 33 is coupled to the wheel. The shaft coupler 33 further comprises four connection apertures 34 which align with the four inwardly-facing indents 30 to allow connection of the coupler to the wheel.

The internal webbing pattern of the launch wheels 15 (the hub 26, the spokes 27, and the mid-ring 28) minimises weight whilst maintaining maximum strength. In use, the launch wheels are intended to spin up to 5000 RPM, and need to withstand and maintain their shape and integrity under speed, weight and constant ball launching impact pressure over time. This manufacturing method of extrusion to create the launch wheels is also much more cost effective compared to other metal methods including Die Casting and CNC milling to create wheels.

A PBR rubber layer of Shore Hardness 50 A is affixed to the outer rim of the launch wheels 15. This is to both minimise damage to the balls when launching and maximise grip on the balls by the launch wheels. The rubber layer has a thickness of substantially 13 mm, so that each launch wheel 15 has an overall diameter of substantially 170 mm.

The internal webbing pattern (the hub 26 and mid-ring 28) allows for a reduced weight of the launch wheel 15 as less material is required, as compared to a normal circular hub wheel (with no material between the spokes). However, the internal webbing pattern assists with maintaining the strength of the launch wheel due to the solid outer rim layer to which the evenly spaced and symmetrical spokes are fixed. The spokes extend outwards from the central hub to assist with maintaining centrifugal balance, and to ensure that the launch wheels always spin predictably, consistently and accurately under use. The outer rim of the wheel also acts a solid flat surface to bond the rubber securely. Using the process of extrusion to create the launch wheel also means minimum wastage in the production process, as material is not cut away from a material block, it is formed within a pre-set extrusion design template.

Ball Feed

The device can be safely used with or without a ball feed 4 attached. When using without the ball feed connected the user simply places the ball through the aperture of the top plate 25 manually. As shown in FIG. 1, a ball feed 4 can connect to the rear outer end of the top of the framework tube 20*a*. The ball feed 4 in this embodiment comprises a single tubular framework 4 formed as a framework tube in a similar fashion to the framework tube 20*a*, with metal rods forming a skeleton tube having flat plates 29*a*, 29*b* at either end. In the preferred embodiment, the ball feed top and base plates 29*a*, 29*b* respectively are formed of a composite board material, the same as for the base plate 5. The metal struts are curved so that the overall form is of a curved tube.

The ball feed base plate 29*b* at the lower end of the tube 4 is connected to the flat, horizontally aligned ring or top plate 25 at the top of the framework tube 20*a* via a key hole lock mechanism—apertures are formed in one plate into which thumb screws on the other plate fit in a certain alignment. The plates are brought together in a certain alignment so that the thumb screws fit through the apertures, and the plates are then moved into the 'use' position. The thumbscrews are then tightened so that the tube 4 and the framework tube 2*a* are held together. This helps to ensure that the ball feed 4 remains stable at all times and can be easily and quickly removed for the convenience of transportation, and then reconnected as required for use.

As shown in FIG. 1, the tube 4 is angled or curved through substantially 40 degrees. When attached, this ensures that the rear entry at the outer end of tube 4 faces upwards and rearwards, and the other/lower end is aligned vertically and connecting with the framework tube 20*a*. The ball feed tube 4 also extends outwards rearwardly from the base section 2, to counter-balance the weight of the remainder of the training device 1 and to ensure that it remains stable. The arrangement described also positions the ball entry for the ball feed at a ball entry height of substantially 1.3 metres from the ground or other surface on which the training device 1 is positioned, thus allowing players and coaches of all playing ages to place balls in the feed during use. Up to six FIFA regulation-size balls (size 3, 4 or 5) can be stored in the ball feed 4 at any one time.

A pair of solenoids 24 are mounted at or towards the end of lower part 4*b* that connects with the framework tube 20*a*, in the preferred embodiment just above the top plate 25. The solenoids 24 are located on diametrically opposed sides. The solenoids and tube are configured to provide reliable and safe ball launching regardless of football size (e.g. regulation size 3, 4 or 5 footballs). For example, this arrangement will not allow multiple small footballs (e.g. small footballs such as regulation size 3 footballs) to slip through and exit more than one at a time without user instruction, and also so that the combined weight of multiple stacked larger footballs (e.g. regulation size 5 footballs) cannot push through the solenoids and exit unexpectedly, without user instruction. Any combination or number of size 3, 4 and 5 footballs can be placed into the ball feed with assurance that only one ball at a time will be released by the diametrically opposed solenoids when activated. When not activated, the moving part of each of the solenoids 24 extends equally inwards and rests a short distance into the passage of part 4*b*—an inwards position where it extends far enough into the passage so that movement of a ball through the tube is blocked or prevented, as shown in FIG. 7. That is, the solenoids 24 in an inwards position block the end of the passage through tube 20*a*, and prevent a ball from passing through.

When the solenoids 24 are activated into an outwards position, the moving parts of the solenoids do not extend into the passage, and the balls can pass freely along the passage. The solenoids 24 are sized and positioned to ensure that size 3, 4 or 5 balls can be stored and then launched sequentially at any given time, by activating the solenoids 24 to the outwards position to let a ball drop through the end of the passage through tube 20*a*. The diametrically opposed solenoids 24 and the tube 20*a* are configured so that balls with a maximum diameter of 23 cm and a minimum diameter of 18.4 cm can be stored and launched sequentially and without letting more than one ball through at a time.

Figure 10A:
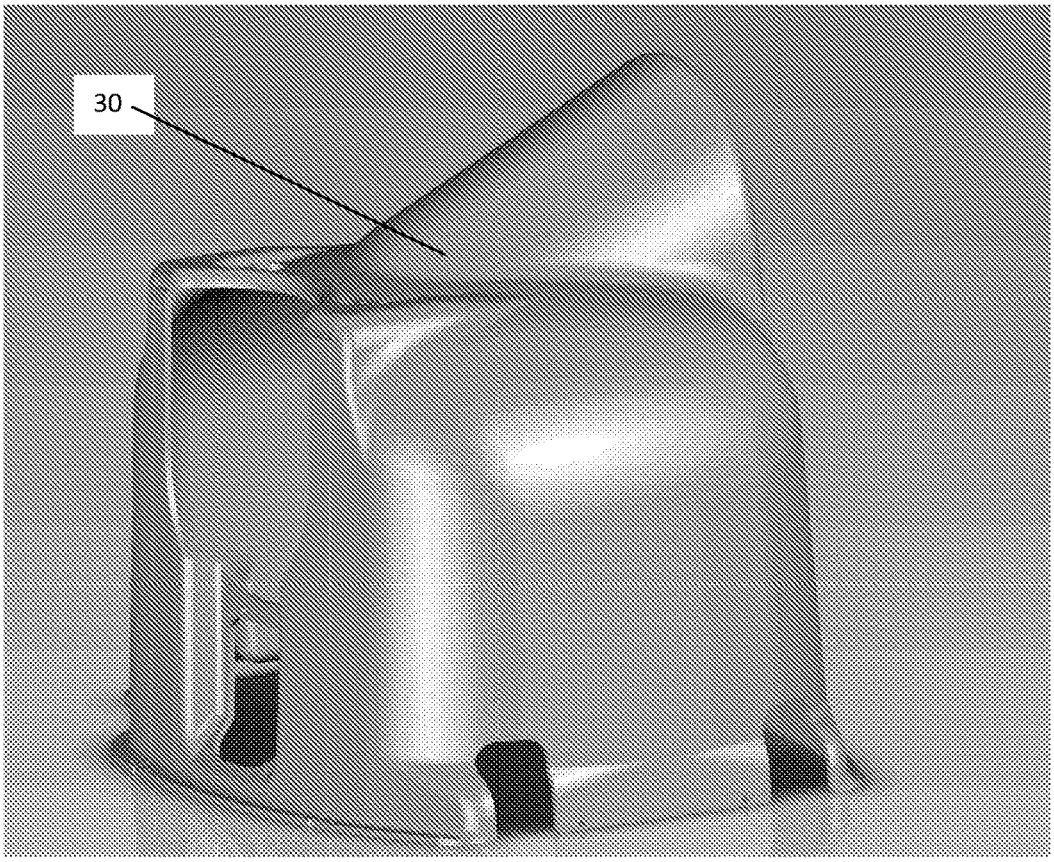
FIG. 10*a* shows a front perspective view of a cover for the training device, the cover fitting over the top of the base plate to enclose the elements thereon, and having rear and front apertures for the ingress and launching of balls respectively.
Figure 10B:
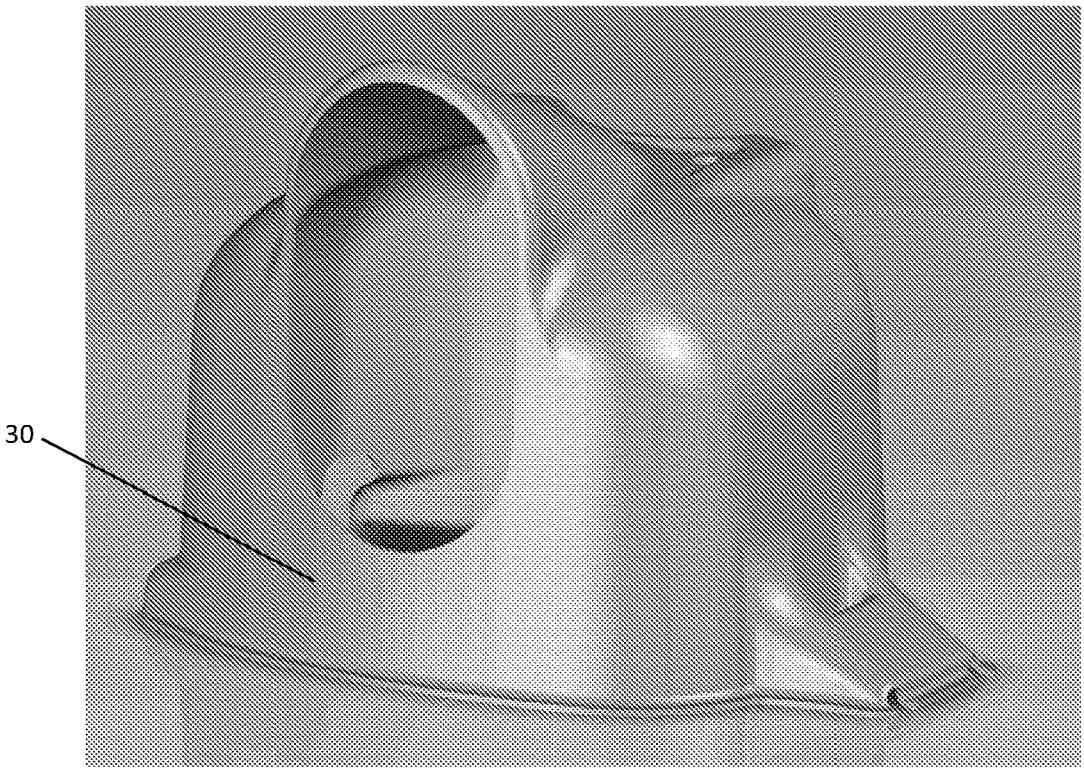
FIG. 10*b* shows a rear perspective view of the cover of FIG. 10*a*.

A cover 30 is shown in FIG. 10. This connects to the base plate 5 and encloses all the elements thereon, the cover having apertures at the front and rear to allow balls from the ball feed to enter the cover and be launched out of the front.

Figure 11:
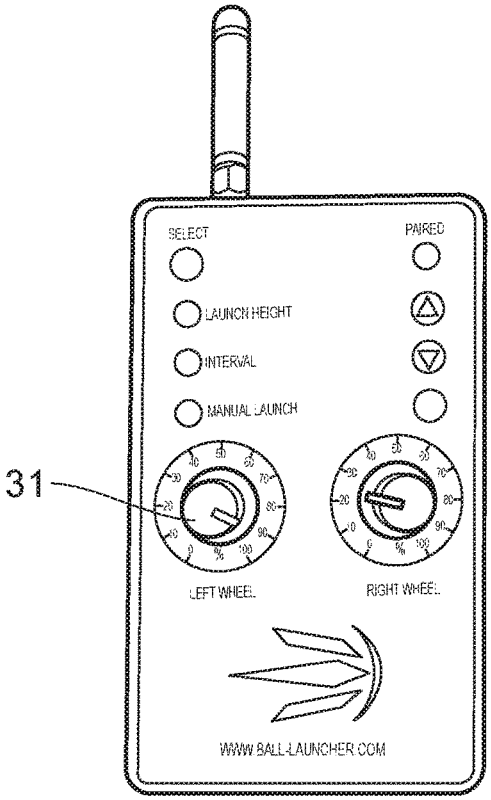
FIG. 11 shows a remote control for the training device of the present invention, the remote control configured for adjustment of the rotation speed of each of the launch wheels, independent of the other wheel.

A remote control 31 is shown in FIG. 11. This has controls to allow it to control the launching device. The rotation speed of each of the launch wheels can be adjusted, independently of the speed of the other launch wheel, so that the exit speed can be adjusted and/or spin can be applied to the exiting football. The remote control also allows a user to adjust the exiting football launch height up and down via the linear actuator, as well as to activate the solenoids inside the ball feed in order to launch footballs remotely. The solenoids can be manually operated at the press of a button, or set to operate automatically and launch footballs at intervals—e.g. at 3, 5 or 8-second intervals.

A connector panel (not shown) is located on the rear of the machine. The connector panel contains controls for the apparatus 1 and sockets for connection of various cables and similar. The controls and sockets include an on/off/on switch which enables the user to switch between the use of internal battery power and external mains power, or an additional external battery. A three-pin socket is included, where either the battery charger can be plugged in to charge the internal battery, or the external mains power solution or an additional battery is plugged in.

A four-pin socket is also provided, where a cable from the ball feed is plugged in, so that power is provided for the solenoids within the ball feed to operate.

A nine-pin port is also provided which allows connection of a proprietary plug-in unit. Without the proprietary plug-in plugged in, the ball exit speed of the machine is restricted to around 53% of total available power as a speed limiter in the machine code is activated. However, with the proprietary plug-in unit inserted, the pre-programmed, limited, speed is overwritten to the level programmed within the proprietary plug-in that is inserted, thus providing a faster ball exit speed. This can assist with user safety—a standard 'off the shelf' apparatus is more child-friendly and also provides a purchasable power up offering to customers.

Without the plug-in unit, in the preferred embodiment, the apparatus is restricted to up to 53% motor power only. The maximum ball exit speed is therefore around 35 mph. This makes the apparatus safe for use by children of ages 5-12, and only a limited amount of ball spin is achievable. The apparatus can therefore be used for beginners and youngsters, back garden usage, close range catching, foot control and shooting practice.

With the plug-in unit in place, the apparatus can be taken to full power, giving a maximum ball exit speed of around 60 mph, with ball spin maximised. The apparatus can be used by children over 13 years old, and adult players, in areas such as training pitches or larger training areas. The apparatus in this configuration allows faster close range catching, foot control and shooting practice, longer range crossing and passing practice, and team set-piece practice.

Whilst adding advanced capability tailored to those that want or need it, one of the main problems the plug-in unit solves is safety and providing a football machine that can be easily and sensibly be used with all ages and abilities. For example, there is a lot of difference between a 7-year-old child developing their basic catching skills at 10 mph and a group of late teens or young adults wishing to practice defending 60 mph crosses. This is why the plug-in unit provides a sensible separation between ages and abilities and will help to reduce the risk of injury by restricting capability.

Standard breaker switches are also included as a safety mechanism of the device. If current or amperage levels within the machine exceed twelve amps, the breaker switches automatically turn the machine power off. This provides both user safety and protects the internal components.

A standard battery level meter is also included which indicates the level of internal battery power remaining to the user, so that they are aware of how much power is left and when they should recharge the battery.

A training device 1 according to the invention is advantageous as the launch elevation can be quickly and easily adjusted by activation of the linear actuator, using the remote control. The speed of each of the wheels can be adjusted so as to put spin on the ball. The direction of launch can be quickly and easily adjusted by rotation of the plate 5 from side-to-side on the swivel 6.

Different types of spin can be imparted on the ball if the firing wheels rotate at differing speeds, and this can be combined with the elevation of the firing wheels to create a wide variety of ball flight characteristics and spin types.

Balls are delivered consistently to the same designated spot at the same speed. Variations in ball flight will only occur due to differing inflation pressures or different panel arrangements that affect the ball's aerodynamics (known as the 'Magnus effect'). This means that every ball delivered from a corner, cross, pass, free kick or shot for example is a "good ball" for coaches to facilitate training and practice.

The use of a 12V battery as outlined above has been found to deliver approximately four hours of field play when fully charged. An additional battery can be plugged in if extended use is required, to allow the machine to be used for up to eight hours constant player training over the course of the day. Generally, batteries of this type take around four hours to fully discharge.

Using the device 1 alleviates the present need for coaches to manually deliver balls to players. This allows coaches to concentrate more on improving the techniques and core skills of their squads rather than concentrating on how to deliver balls to them. This not only benefits players, but it also lessens the impact of RSI on coaches knees and backs in particular, or any other type of injury.

The device 1 can be disassembled as outlined above, with a user detaching the ball feed 4 from the base section for transportation or storage. This enables a user to fit the device 1 into a small area such as the boot of a car, if needed. The frame design keeps the weight low.

The invention claimed is:

1. A training device for ball sports, comprising:

a launching section comprising a pair of launch wheels, the launch wheels having substantially parallel axes of rotation, and an adjustment mechanism configured to adjust the vertical angle of launch of the launch wheels;

a base section supporting the launching section,; the base section comprising a base swivel comprising an outer perimeter base sized and shaped to provide a stable contact with the ground or other surface on which the base section is resting, and at least one leg connected to the outer perimeter base and extending upwards to connect with and support the launching section above the ground or other surface, the leg or legs and launching section mutually configured for rotational connection so that the base section can freely swivel in substantially the horizontal plane, wherein the launch wheels comprise semi-hollow cylinders having a circumferential outer rim, a central connection hub, and a plurality of radial spokes, the launch wheels having a height of substantially 100 mm, and wherein each launch wheel further comprises a mid-ring surrounding and spaced from the central connection hub, the hub and mid-ring connected to the circumferential outer rim via the radial spokes, the hub circular in plan view, with a central, circular aperture having a square or rectangular cut-out formed at one side.

2. The training device for ball sports as claimed in claim 1, wherein the outer perimeter base comprises a substantially circular ring.

3. The training device for ball sports as claimed in claim 1, wherein the at least one leg comprises a plurality of legs, arranged to extend substantially in parallel to one another across the outer perimeter base each side of the centre of the outer perimeter base.

4. The training device for ball sports as claimed in claim 1, wherein the base section comprises a substantially flat plate, at least one travel wheel connected at one side of the plate, and a handle extending from the opposite side of the plate to the travel wheels, the flat plate, wheels and handle configured so that the wheel or wheels are out of contact with the ground or other surface in use, and so that a user can lift the handle to pivot the base section to bring the wheel or wheels into contact with the surface on which the base swivel rests.

5. The training device for ball sports as claimed in claim 1, wherein the launching section further comprises a feed frame configured to allow balls to be fed from the rear of the launching section through the launch wheels, and so that balls roll downwards and forwards with substantially the same speed each time.

6. The training device for ball sports as claimed in claim 1, wherein the launching section further comprises a feed frame configured to allow balls to be fed from the rear of the launching section through the launch wheels, the feed frame configured so that balls enter the feed frame in a substantially vertical direction, and exit into the wheels in a substantially horizontal direction.

7. The training device for ball sports as claimed in claim 5, wherein the launching section comprises a framework of struts curving from the vertical to the horizontal.

8. The training device for ball sports as claimed in claim 5, further comprising a ball feed, the ball feed comprising a tubular framework formed into a curved tube, the inner end of the ball feed and outer/top end of the feed frame configured for mutual connection, the curved tube of the ball feed curving backward and downward toward the horizontal when connected to the feed frame.

9. The training device for ball sports as claimed in claim 8, wherein the curved tube of the ball feed curves through substantially 40 degrees.

10. The training device for ball sports as claimed in claim 8, wherein a plurality of solenoids are mounted at or towards the lower end of the ball feed, located so that when in a non-activated state, the solenoids extend into the ball feed to prevent the passage of balls out of the lower end of the ball feed, and that when activated, the solenoids move outwards to allow only one ball at a time to pass through the lower end of the ball feed.

11. The training device for ball sports as claimed in claim 1, further comprising an outer grip layer at least partly covering the circumferential outer surface of the circumferential outer rim.

12. The training device for ball sports as claimed in claim 11, wherein the outer grip layer comprises a rubber layer comprising a PBR rubber layer of Shore Hardness 50A.

13. The training device for ball sports as claimed in claim 1, further comprising a battery configured provide power to the training device, and a battery box, the box configured to contain the battery in use and to mount to the base section.

14. The training device for ball sports as claimed in claim 13, wherein the battery box and training device further comprise connectors mutually configured to connect to provide power from the battery to the training device.

15. A training device for ball sports, comprising:

a launching section comprising a pair of launch wheels, the launch wheels having substantially parallel axes of rotation, and an adjustment mechanism configured to adjust the vertical angle of launch of the launch wheels;

a base section supporting the launching section, wherein the base section comprising a base swivel comprising an outer perimeter base sized and shaped to provide a stable contact with the ground or other surface on which the base section is resting, and at least one leg connected to the outer perimeter base and extending upwards to connect with and support the launching section above the ground or other surface, the leg or legs and launching section mutually configured for rotational connection so that the base section can freely swivel in substantially the horizontal plane, wherein the launch wheels comprise semi-hollow cylinders having a circumferential outer rim, a central connection hub, and a plurality of radial spokes, the launch wheels having a height of substantially 100 mm, wherein each launch wheel further comprises a mid-ring surrounding and spaced from the central connection hub, the hub and mid-ring connected to the circumferential outer rim via the radial spokes, the hub circular in plan view, with a central, circular aperture having a square or rectangular cut-out formed at one side, and wherein every second one of the spokes runs through the mid-ring to connect with the hub.

16. A training device for ball sports, comprising:

a launching section comprising a pair of launch wheels, the launch wheels having substantially parallel axes of rotation, and an adjustment mechanism configured to adjust the vertical angle of launch of the launch wheels;

a base section supporting the launching section, wherein the base section comprising a base swivel comprising an outer perimeter base sized and shaped to provide a stable contact with the ground or other surface on which the base section is resting, and at least one leg connected to the outer perimeter base and extending upwards to connect with and support the launching section above the ground or other surface, the leg or legs and launching section mutually configured for rotational connection so that the base section can freely swivel in substantially the horizontal plane, wherein the launch wheels comprise semi-hollow cylinders having a circumferential outer rim, a central connection hub, and a plurality of radial spokes, the launch wheels having a height of substantially 100 mm, wherein each launch wheel further comprises a mid-ring surrounding and spaced from the central connection hub, the hub and mid-ring connected to the circumferential outer rim via the radial spokes, the hub circular in plan view, with a central, circular aperture having a square or rectangular cut-out formed at one side, and wherein the mid-ring is configured with four inwardly-facing indents at substantially equal intervals, directly adjacent to spokes.

* * * * *